United States Patent [19]

Allison, Jr.

[11] Patent Number: 5,027,513

[45] Date of Patent: Jul. 2, 1991

[54] SEAL RELIEF DOCTOR BLADE

[75] Inventor: Thomas K. Allison, Jr., Moorestown, N.J.

[73] Assignee: Allisontech Sales, Inc., Moorestown, N.J.

[21] Appl. No.: 478,391

[22] Filed: Feb. 12, 1990

[51] Int. Cl.[5] ..... B26B 3/00; A46B 15/00; B41F 3/36; B41F 3/38

[52] U.S. Cl. ..... 30/169; 15/256.51; 101/157; 101/169

[58] Field of Search ..... 30/164.9, 169, 170, 30/171, 172, 136, 299, 329; 15/256.51; 101/157, 169; 355/299

[56] References Cited

U.S. PATENT DOCUMENTS

| | | | |
|---|---|---|---|
| 4,184,429 | 1/1980 | Widmer | 101/169 |
| 4,425,848 | 1/1984 | Bell | 101/169 |
| 4,461,211 | 7/1984 | Wesselmann | 101/169 |
| 4,508,032 | 4/1985 | Phillipp | 101/169 |
| 4,590,855 | 5/1986 | Schommer et al. | 101/157 |
| 4,735,144 | 4/1988 | Jenkins | 15/256.51 |
| 4,821,672 | 4/1989 | Bruno | 101/169 |
| 4,895,071 | 1/1990 | Benton | 101/169 |

*Primary Examiner*—Douglas D. Watts
*Assistant Examiner*—Paul M. Heyrana, Sr.
*Attorney, Agent, or Firm*—Norman E. Lehrer

[57] ABSTRACT

A relatively thick-bodied doctor blade made of a low friction plastic material includes a seal relief bevel of between approximately 5 and 10 degrees. The blade then tapers to a tip support shape and tip of between approximately 0.001 and 0.005 inch. When used in conjunction with a chamber type inking system, the doctor blade cooperates with the chamber end seals to form a more positive and controlled seal therebetween.

6 Claims, 1 Drawing Sheet

SEAL RELIEF DOCTOR BLADE

BACKGROUND OF THE INVENTION

The present invention is directed toward a doctor blade and, more particularly, to such a blade which is used in a chambered doctor blade system with end seals.

Chambered doctor blade inking systems employed in flexographic printing and Gravure coating often include elastomeric, elastomeric foam, felt or other deformable end seals. One function of the seals is to prevent ink from freely flowing out of the ends of the chamber, onto the rotating ends and journals of the engraved cylinder, where it would be sprayed tangentially by the rotation of the cylinder. Another function of the end seals is to allow static ink pressure above atmospheric pressure to be maintained inside the chamber in order to aid in the distribution and delivery of the ink to the engraved roll. A third function is to permit controlled ink leakage to provide lubrication and prevent excessive heating of the seals and blades. The controlled leakage is then intercepted and collected by other features of the design, all of which is well known in the art.

Chambered doctor blade inking systems normally include a pair of doctor blades and a seal at each end located between the doctor blades. The seals typically contact the wetted face of the blades and the segment of the engraved cylinder located between the two doctor blades.

With various types of ceramic-surfaced engraved cylinders, it is desirable to reduce friction and resulting doctor blade wear and/or roll surface damage by using doctor blades made of polyethylene, Teflon, or other plastic materials having a low coefficient of friction in contact with the ceramic surface. As these materials tend to have a relatively low tensile strength and modulus of elasticity, as well as relatively low dimensional stability, it is necessary to use thick blade body sections typically from between approximately 0.030 and 0.080 inch as opposed to the more conventional 0.006 to 0.008 inch sections of spring steel doctor blades. The working tip of the blade in contact with the engraved cylinder must, however, be small (approximately 0.001 to 0.005 inch) to conform to the cylinder with low applied force and to avoid unwanted hydraulic blade lifting effects.

These factors have resulted in a plastic doctor blade design cross section with a beveled tip incorporating an approximately 45 to 55 degree included plastic angle. However, this blade cross section can create end sealing problems making it necessary to add additional shaping to the seal to conform to the blade/cylinder interface. The required shape of the end seal at this interface is difficult to predict and/or achieve because of the complex interaction of blade deflection under applied actuating load, variable internal chamber pressure, and variable seal deformation.

SUMMARY OF THE INVENTION

The present invention is designed to overcome the deficiencies of the prior art described above. This is accomplished by a relatively thick-body doctor blade made of a low friction plastic material including a seal relief bevel of between approximately 5 and 10 degrees. The blade then tapers to a tip support shape and tip of between approximately 0.001 and 0.005 inch. When used in conjunction with a chamber type inking system, the doctor blade cooperates with the chamber end seals to form a more positive and controlled seal therebetween.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
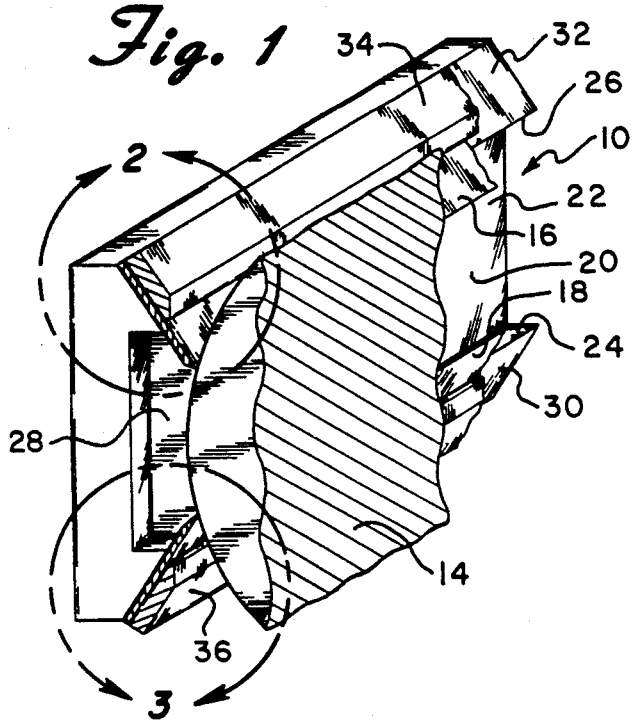
FIG. 1 is a perspective view shown partially in cross section and partially broken away of a chambered doctor blade system which includes both a conventional prior art doctor blade and a doctor blade constructed in accordance with the principles of the present invention.

Referring now to the drawing in detail wherein like reference numerals have been used throughout the various figures to designate like elements, there is shown in FIG. 1 a chambered doctor blade system designated generally as 10. The doctor blade system which is intended to apply ink to the circumferential surface 12 (FIG. 2) of roller 14 includes an upper blade 16 which, for the purposes of illustration, is a conventional plastic blade and a lower blade 18 which is constructed in accordance with the principles of the present invention.

The chambered doctor blade system 10 of FIG. 1 is per se well known to those skilled in the art and essentially includes an interior chamber 20 defined by a rear wall 22, a lower forwardly extending wall 24 and an upper forwardly extending wall 26. A pair of seals made of felt, elastomeric foam or other deformable plastic are located at either end of the chamber 20. The left end seal 28 is shown in FIG. 1 while the right end seal is not shown. A plurality of openings, also not shown, pass through the rear wall 22 in order to provide a supply of ink under pressure to the chamber 20.

The exterior surfaces 30 and 32 of the bottom and top walls 24 and 26, respectively, are angled inwardly toward the center so as to be at an angle of approximately 90 degrees to the surface 12 of the cylinder 14. The upper doctor blade 16 rests on this surface 32 while the lower doctor blade 18 rests on the surface 30. Each is tightly clamped in place by the use of the upper and lower clamping blocks 34 and 36. As is well known in the art, the doctor blades extend outwardly from their supports so that their tips engage the outer surface 12 of the cylinder 14 substantially along the entire length of the cylinder.

Figure 2:
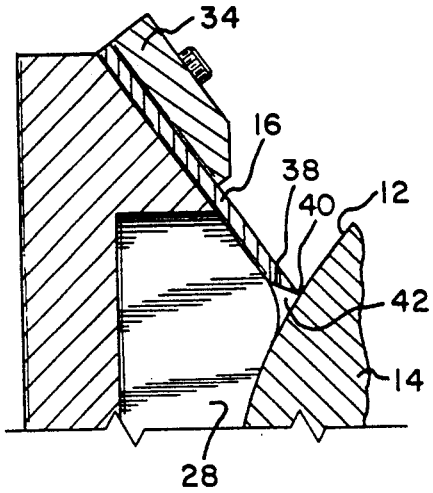
Fig. 2 PRIOR ART
FIG. 2 is a cross-sectional view of the section identified as 2 in FIG. 1 and illustrating the prior art.
Figure 3:
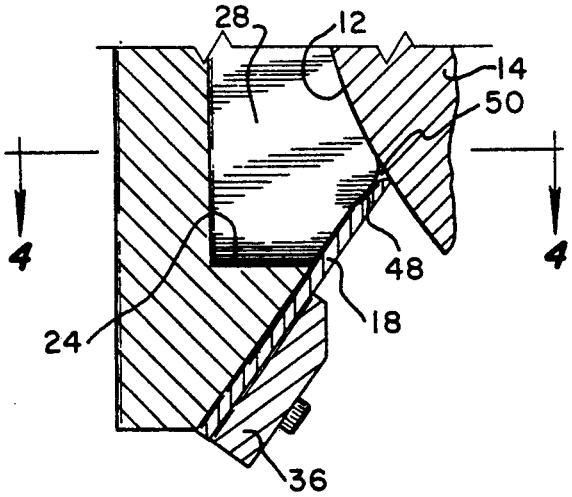
FIG. 3 is a cross-sectional view of the section identified as 3 in FIG. 1 and illustrating the present invention.
Figure 4:
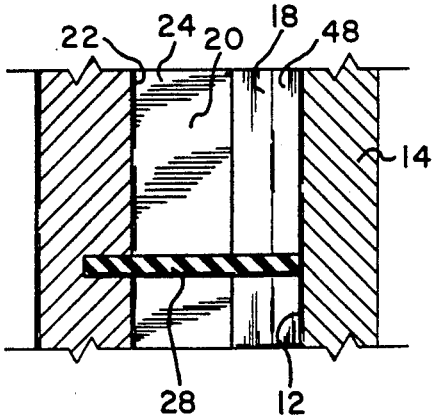
FIG. 4 is a cross-sectional view taken through the line 4—4 of FIG. 3.

As shown most clearly in FIGS. 1, 2 and 3, the end seals such as end seal 28 contact the inner face or surface of each of the blades and the segment of the surface 12 of the cylinder 14 located between the two doctor blades. As is also well known in the art, the purpose of these seals is to prevent the ink within the chamber 20 from freely flowing out of the ends of the chamber. The seals also allow static ink pressure above atmospheric pressure to be maintained inside the chamber.

The upper doctor blade 16 illustrates a substantially conventional plastic doctor blade and is comprised of polyethylene, Teflon or other plastic material having a low coefficient of friction with respect to the ceramic surface of the cylinder 14. The blade body is between approximately 0.03 and 0.08 inch thick but includes a taper or bevel 38 at the forward end thereof leading to the tip 40 of the blade which has a thickness of approximately 0.001 to 0.005 inch. Bevel 38 forms an angle of approximately 45 to 55 degrees from the plane of the major portion of the blade 16.

As can be seen most clearly in FIG. 2, the bevel 38 creates a sealing problem in that a relatively large gap 42 is created between the seal 28, blade 16 and cylinder surface 12. This gap allows excess ink to flow out of the chamber 20 which can damage the rotating ends and journals of the cylinder and also reduces the pressure of the ink within the chamber. While it may be theoretically possible to reshape the outer edge of the seal 28, the required shape of the end seal is difficult to predict and/or achieve because of the complex interaction of blade deflection under applied actuating load, variable internal chamber pressure, and variable seal deformation as pointed out above.

Figure 5:
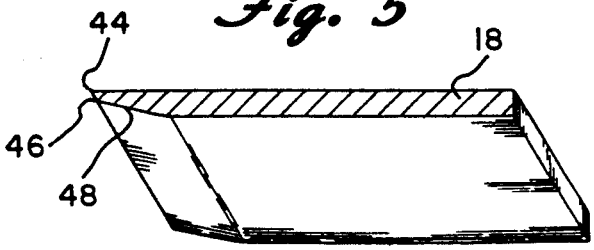
FIG. 5 is a perspective view of a section of a seal relief doctor blade according to the invention.

FIGS. 3 and 5 illustrate the present invention and the manner in which the same solves the foregoing problem. Lower blade 18 is constructed in a manner very similar to blade 16 and is comprised of similar materials. It has a main blade body also having a thickness of between approximately 0.03 and 0.08 inch and also includes a tip 44 which has a thickness of approximately 0.001 to 0.005 inch. Similar, the doctor blade 18 also includes a small bevel portion 46 having an angle of approximately 45 to 55 degrees adjacent the tip 44. However, located between the main body portion of the blade 18 and the bevel portion 46 is a transition area created by a seal relief bevel 48 of between approximately 5 and 10 degrees. The advantage of this additional taper or bevel 48 is clearly illustrated in FIG. 3.

FIG. 3 shows the interface between the surface 12 of cylinder 14, the outer edge of the end seal 28 and the inner surface of the blade 18. As a result of the transition area or bevel 48, it can be seen that the seal 28 more accurately conforms to the shape of the blade 48 adjacent the end thereof thereby leaving a gap 50 which is substantially smaller than the gap 42 shown in FIG. 2.

It should be noted that it is not desirable to totally eliminate the gap 50. Rather, the small "leak by" area is desirable in order to provide lubrication and cooling of the seals and blades. This controlled leakage is intercepted and collected by means well known in the art.

While the chambered doctor blade inking system 10 has been illustrated with a substantially conventional plastic blade 16 as the upper blade, it should be readily apparent that this is for illustration and comparison purposes only. It is contemplated that a seal relief beveled doctor blade such as blade 18 would be used as both the upper and lower blade in a chambered system. Furthermore, the precise configuration of the blade is by way of example only. The shape of the tip support or beveled portion and the tip itself on a seal relief blade will depend on various factors including the engraving screen-count used on the roll, the need for resistance to damage caused by particles in the ink or coating being applied, the mechanical properties of the blade material and the machinability of the blade material.

The present invention may be embodied in other specific forms without departing from the spirit or essential attributes thereof and accordingly reference should be made to the appended claims rather than to the foregoing specification as indicating the scope of the invention.

I claim:

1. In a plastic doctor blade for use in a chambered doctor blade system having flexible end seals which press against the inner surface of said blade and wherein said blade has a body portion having a thickness of between approximately 0.030 and 0.080 inch and having a working tip having a thickness of between approximately 0.001 and 0.005 inch and adapted to contact the surface of an engraving cylinder the improvement comprising a transition area formed in said blade between said body portion and said working tip, said transition portion including a bevel of between approximately 5 to 10 degrees.

2. The invention as claimed in claim 1 wherein said transition portion includes an additional bevel of between approximately 45 to 55 degrees, said additional bevel lying between said first-mentioned bevel and said tip.

3. The invention as claimed in claim 1 wherein said plastic is polyethylene.

4. In a chambered doctor blade system having a doctor blade and including flexible end seals which press against the inner surface of said blade and wherein said blade has a body portion having a thickness of between approximately 0.030 and 0.080 inch and having a working tip having a thickness of between approximately 0.001 and 0.005 inch which contacts the surface of an engraving cylinder to which the doctor blade system is applied, the improvement comprising said blade being comprised of plastic and including a transition area formed in the inner surface of said blade between said body portion and said working tip, said transition portion including a bevel of between approximately 5 to 10 degrees.

5. The invention as claimed in claim 4 wherein said transition portion includes an additional bevel of between approximately 45 to 55 degrees, said additional bevel lying between said first-mentioned bevel and said tip.

6. The invention as claimed in claim 4 wherein said plastic is polyethylene.

* * * * *